US006279545B1

(12) United States Patent
Frank et al.

(10) Patent No.: US 6,279,545 B1
(45) Date of Patent: Aug. 28, 2001

(54) FUEL SUPPLY SYSTEM FOR FUEL SUPPLY OF INTERNAL COMBUSTION ENGINE

(75) Inventors: Kurt Frank, Schorndorf; Willi Strohl, Beilstein, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/354,557

(22) Filed: Jul. 15, 1999

(30) Foreign Application Priority Data

Jul. 21, 1998 (DE) ..... 198 32 842

(51) Int. Cl.[7] ..... F02M 37/04
(52) U.S. Cl. ..... 123/514; 123/179.17; 137/527
(58) Field of Search ..... 123/514, 509, 123/510, 446, 456, 179.17, 497; 137/565.35, 115.26, 514.5, 514, 527

(56) References Cited

U.S. PATENT DOCUMENTS 4,353,385 * 10/1982 Maisch et al. ..... 137/115.26
4,791,950 * 12/1988 Pedersen ..... 137/115.26
5,050,636 * 9/1991 Sagawa et al. ..... 137/494
5,429,096 * 7/1995 Fukasawa et al. ..... 123/514
5,537,980 * 7/1996 Yamamoto ..... 123/447
5,713,389 * 2/1998 Wilson, Jr. et al. ..... 137/515.7
5,715,798 * 2/1998 Bacon et al. ..... 123/514
5,873,349 * 2/1999 Tuckey et al. ..... 123/514
5,983,869 * 11/1999 Cooke et al. ..... 123/514
6,058,912 * 5/2000 Rembold et al. ..... 123/516

FOREIGN PATENT DOCUMENTS 42 42 242 A1 6/1994 (DE) .

* cited by examiner

*Primary Examiner*—Carl S. Miller
(74) *Attorney, Agent, or Firm*—Michael J. Striker

(57) ABSTRACT

A fuel supply system for fuel supply of an internal combustion engine has a fuel supply container, a fuel supply unit having a pressure limiting valve providing an adjustable maximum pressure, a fuel supply conduit having a pressure regulating valve adjustable to an operational pressure for maintaining a regulated operational pressure in the fuel supply conduit, a fuel return conduit adapted to connect the internal combustion engine with the fuel supply container, and a delay valve associated with the pressure regulating valve for loading the fuel supply conduit with an initial pressure which is higher than an operational pressure.

15 Claims, 2 Drawing Sheets

FUEL SUPPLY SYSTEM FOR FUEL SUPPLY OF INTERNAL COMBUSTION ENGINE

BACKGROUND OF THE INVENTION

The present invention relates to a fuel supply system for fuel supply of an internal combustion engine from a fuel container by means of a fuel supply unit.

Fuel supply systems of the above mentioned general type are known in the art, as disclosed for example in the German patent document DE 42 42 242 A1. The fuel supply unit of such a system is arranged in the fuel container and conventionally has a pressure limiting valve with adjustable maximum pressure. A pump in the fuel supply unit pumps the fuel from the supply container into a fuel supply conduit. Conventionally, the operational pressure of the fuel supply conduit is lower than the maximum pressure which is monitored by the pressure limiting valve. If the maximum pressure is exceeded, the pressure limiting valve which is usually located in the upper region of the housing of the fuel supply unit, supplies back the excessive fuel into the fuel container. The operational pressure in the fuel supply conduit is controlled by an adjustable pressure regulating valve which discharges the excessive fuel into the fuel return conduit for maintaining a regulated operational pressure, so that in the internal combustion engine conventionally only the operational pressure acts.

The known fuel supply system has the disadvantage that the fuel supply pressure increase over the operational pressure is not possible without adjustment of the pressure regulating valve for the fuel in the fuel supply conduit. A short-term excess of the operational pressure in the fuel supply conduit, which in particular is required in a cold start phase in an internal combustion engine or in a warm start phase, is thereby possible only via an adjustment of the nominal value for the regulated operational pressure of the pressure regulating valve or by an electrically operating additional pump. During adjustment of the operational pressure in each starting phase, the regulated operational pressure must be adjusted. There is the disadvantage for the known fuel supply systems that the operational pressure in the fuel supply conduit is not exactly reproducable after each starting step. In another case, an electrically operating additional pump which is switched off after the starting phase, has the disadvantage of increased cost and increased construction, maintenance and operational expenses for the additional pump.

SUMMARY OF THE INVENTION

Accordingly, it is an object of the present invention to provide a fuel supply system for fuel supply of an internal combustion engine from a fuel container by a fuel supply unit, in which once adjusted nominal value of an operational pressure in the fuel supply conduit must not be changed for a starting or running-on phase of the internal combustion engine.

In keeping with these objects and with others which will become apparent hereinafter, one feature of present invention resides, briefly stated in a fuel supply system of the above mentioned type, in which the pressure regulating valve is associated with a delay valve for loading the fuel supply conduit with an initial pressure which is higher than the operational pressure and preferably corresponds to the maximum pressure.

The inventive fuel supply system can provide a fuel supply of an internal combustion engine from a fuel container by means of a fuel supply unit. For a start or a running-on phase of the internal combustion engine, an initially increased pressure is obtained in that, a delay valve is pre-switched to the conventional pressure regulating valve. It first hinders a direct connection between the fuel supply conduit and the pressure regulating valve. Thereby in the fuel supply conduit an increased supplied pressure is built up, which reaches the adjustable maximum pressure of a pressure limiting valve which has the fuel supply unit, and thereby supplies the required pressure for the injection process in the starting phase of an internal combustion engine.

The inventive pressure increase by a short-time standby time of the pressure regulator has the advantage that, during a direct fuel injection the motor in the starting case can be supplied directly from the fuel supply unit so that no second additional pump is needed. Thereby a simple and efficient advantageous possibility is provided to increase the system pressure of the fuel supply system for the direct fuel injection in the starting case, until the delay valve lifts the standby of the pressure regulator.

In accordance with a preferable embodiment of the present invention, the delay valve has an inlet, a delayed operational pressure outlet, and a throttled outlet. The inlet of the delay valve is connected with a branch conduit of the fuel supply conduit. The operational pressure regulator which with conventional construction is directly connected with the branch conduit is in accordance with the present invention is switched later. In other words, when the fuel supply unit is turned into operation, its pump is started and the maximum pressure provided by the pressure regulating valve is built up and is available at the inlet of the delay valve. The maximum pressure can be adjusted to the starter conditions of a fuel direct injection by corresponding design of the pressure regulating valve or adjustment of the same within the limits of the pump power of the fuel supply unit. The additional maximum pressure is built up through the throttled outlet of the delay valve with a time delay, until the delay valve releases the operational pressure outlet. Prom this time point, through the branch conduit of the fuel supply conduit, the operational pressure is controlled and regulated by the pressure regulating valve. For this purpose the delayed operational pressure outlet of the delay valve is connected with the inlet of the pressure regulating valve, so that after the delayed time the pressure regulating valve is connected to the fuel supply conduit The delayed buildup of the maximum pressure in the fuel supply conduit is obtained through the throttled outlet of the delay valve, which preferably is connected with the fuel container, so that the excessive fuel is supplied back into the fuel container. By a design of the throttle opening of the throttled outlet, the delayed time can be adjusted to the starter conditions.

In a preferable embodiment, the delayed valve has a housing with at least one prestressed turning element which in a first phase has an immovable position as long as the fuel in the fuel supply conduit is pressureless and with which in a second phase a delaying turning movement is carried out when the fuel supply conduit is set under pressure by the fuel supply unit and has a pressure which is higher than the operational pressure adjustable at the pressure regulating valve and lower or equal to the maximum pressure of the pressure regulating valve. Finally, the turning element in a third phase assumes an operational position in which the inlet of the delay valve is short-circuited directly with the operational pressure inlet of the pressure regulating valve through the delay valve.

For producing and adjusting a prestressing for the turning element, the delay valve is provided with a prestressing device which acts on the turning axis and is arranged outside the housing. Such a prestressing device has for example a spring element which, for producing different prestresses and thereby for adjusting the delay time, is adjustably connected with the axis of the turning element. Thereby there is the advantage that not only the throttling opening provided in the throttling out of the delay valve determines the delay time, but also the delayed time can be finally adjusted additionally by adjustment of the prestressing device. Such an embodiment has the advantage that no additional electrical drive for operation and for switching of the delay valve is needed. Instead the maximum pressure adjustable by the dimensioning and design or by the adjusting element is supplied into the supply conduit of the drive for switching of the delay valve.

A further preferable embodiment of the invention is provided with a delay valve which has at least one prestressed stroke element in a housing, which in a first phase has an immovable position as long as the fuel in the fuel supply conduit is pressureless, and performs a delaying stroke movement in a second phase. When the fuel supply conduit is set by the pressure supply unit under pressure and has a pressure which is higher than the operating pressure adjustable at the pressure regulating valve and lower or equal to the adjusted maximum pressure of the pressure regulating valve, the delayed stroke movement is executed until in a third phase the stroke element has an operational position.

In the operational position in the third phase, the inlet of the delay valve is short-circuited directly with the operational pressure inlet of the pressure valve through the delay vale. Such a delay valve does not need electrical drive, nor for the opening and closing of the inlet for the delaying stroke movement. The delay time during the stroke movement is determined on the one hand by a throttling opening in a throttling outlet of the delay valve, and on the other hand by a spring element which directly applies a pressure force to the stroke piston and with the pressureless supply conduit prestresses the stroke piston in its immovable position and thereby closes the inlet of the delay valve. The delay time in this example is substantially determined by the design of the spring element and the throttling opening.

The hydraulically operated embodiments of a delay valve have the advantage that on the one hand no electrical control is required, and on the other hand, no additional drive aggregates are needed for maintaining a delay time. Furthermore, they can have a relatively compact construction to be integrated in the fuel supply unit.

In a preferable embodiment of the invention the fuel supply system forms an integral unit of the fuel supply unit with the pressure limiting valve, the delay valve and the pressure regulating valve, in a common housing. Such a compact fuel supply system can be position directly in the fuel container and supply, without an electrical additional pump, a sufficient starting pressure in the starting phase of the internal combustion engine. Therefore, the requirements of a gasoline direct injection in the starting phase are reliably satisfied and subsequently an operational pressure which is conventionally required for a pre-supply circuit in the fuel supply conduit is regulated, when the generation of the high pressure required for the injection in the joint high pressure supply conduit is taken over by corresponding aggregates of the internal combustion engine.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
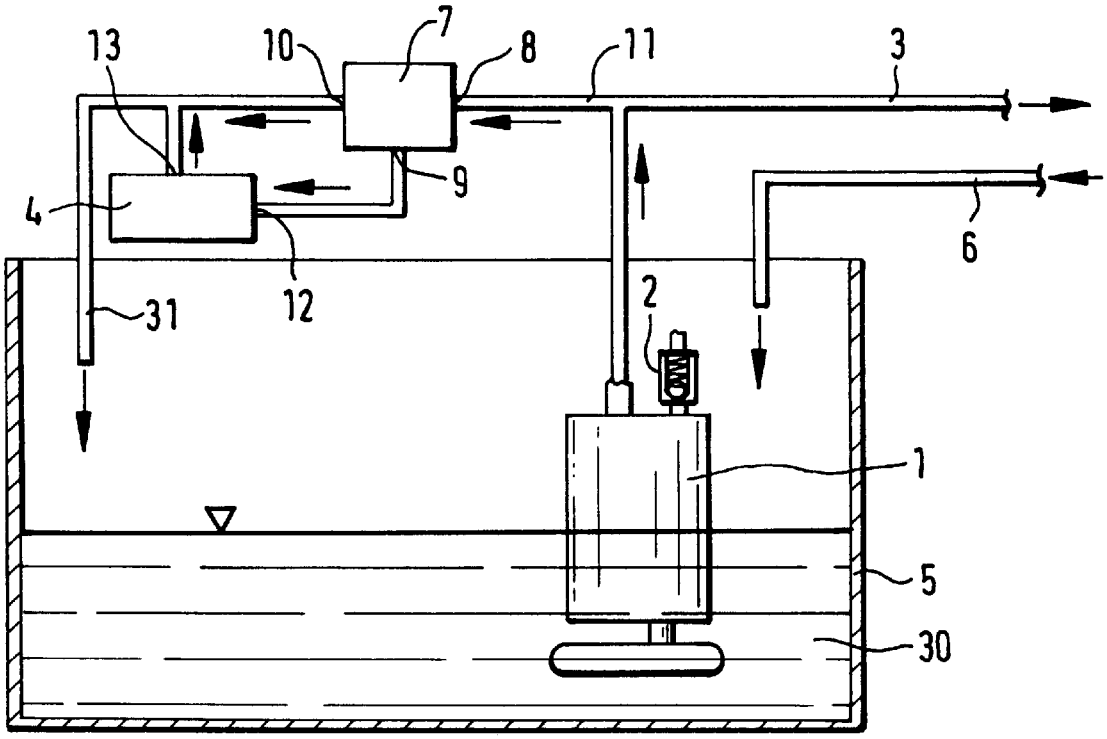
FIG. 1 is a view showing a sketch of a fuel supply system in accordance with the present invention.

FIG. 1 shows a sketch of a fuel supply system in accordance with the present invention. The fuel supply system serves for a fuel supply of an internal combustion engine. The fuel supply system includes at least one fuel container 5 from which the fuel 30 is supplied, a fuel supply unit 1 with a pressure limiting valve 2 providing an adjustable maximum pressure, a fuel supply conduit 3 with a valve set which is connected to a branch conduit 11 of the fuel supply conduit 3 and includes a pressure regulating valve 4 and an upstream delay valve 7 whose outlet connections 10 and 13 are connected to a joint return conduit 31 for fuel, which in turn is in communication with the fuel container 5.

When the fuel supply unit 1 is turned on, the pump produces in the fuel supply unit 1 a pressure which is limited to a maximum value by the pressure limiting valve 2. By arrangement of the pump and the pressure limiting valve 2, the fuel supply unit 1 is formed so that a maximum pressure is provided at the fuel supply conduit 3, which is sufficient in the starting phase of an internal combustion engine to provide a direct fuel injection without an additional pump. When the internal combustion engine is started, additional aggregates take over the supply of the fuel direct injection elements with high pressure from a high pressure supply conduit which is common for all elements. The valve combination of the delay valve and the pressure regulating valve operates through the branching conduit 11 so that after a predetermined delay time, the initial high pressure in the fuel supply conduit is lowered to an operational pressure in the fuel supply conduit. For this purpose the inlet 8 is set under pressure through the branching conduit 11, and inside the delay valve a delay member 34 which can be seen in FIGS. 2–5 separates an inlet pressure chamber 32 from an outlet pressure chamber 33 and moves from a closing position shown in FIG. 3 to an opening position shown in FIG. 5. In the opened position, the delay valve provides a direct connection between the pressure regulating valve 4 and the fuel supply conduit 3 through the branching conduit 11, the inlet 8 of the delay valve 7 and the operating pressure outlet 9 of the delay valve 7, as well as the inlet 12 of the pressure regulating valve 4, so that the pressure in the fuel supply conduit is lowered to a regulated operational pressure by the pressure regulating valve 4 in the fuel circulation circuit. The excessive fuel is supplied through the outlet 13 of the pressure regulating valve 4 via the return conduit 13 for fuel to the supply container 5.

With this fuel supply system, in the starting phase the fuel supply conduit has an increased pressure without electrically operating additional pumps, and supply the joint high pressure power of all injection nozzles without an additional pump and without for example electrical additional drives for a delay valve.

Figure 2:
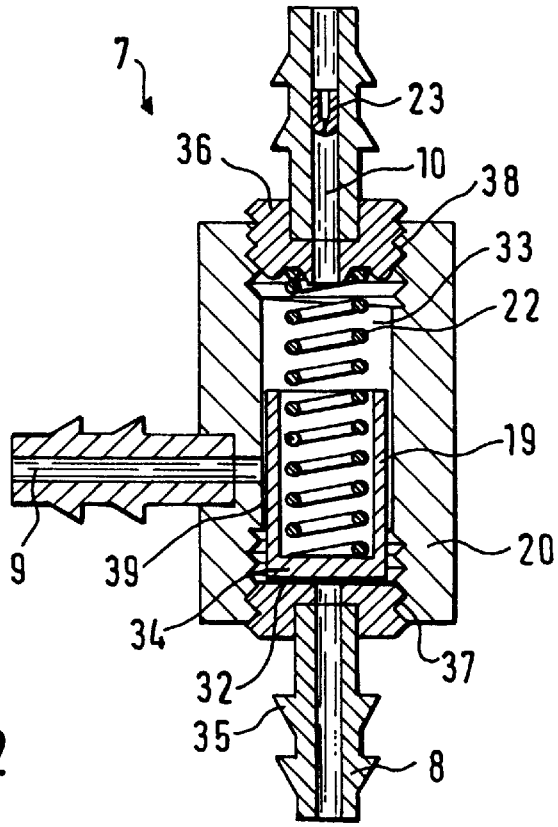
FIG. 2 is a view showing a first embodiment of a hydraulic delay valve of the inventive fuel supply system.

FIG. 2 shows a first embodiment of a hydraulic delay valve 7 in the inventive fuel supply system. The delay member 33 is here a displacement or stroke piston which is held by a spring element 22 in immovable position, and in this immovable position it holds the inlet of the delay valve 7 closed. The stroke or displacement element 19 maintains this position as long as the fuel in the fuel supply conduit 3 is pressureless or in other words is at the level of the surrounding pressure. Due to the spring prestressing, the delay member 34 which in this embodiment is formed as the displacement or stroke element 19 and can slide as a piston in a cylindrical housing 20, is returned back to the stationary position when the fuel pressure in the fuel supply conduit again falls to the surrounding pressure. From this first phase of an immovable position, the delay element 34 is transferred through a second phase when a supply pressure in the fuel supply conduit 3 is built up and acts through the branch conduit 11 on the inlet 8 of the delay valve 7. An inlet pressure chamber 32 increases while an outlet pressure chamber 33 decreases. The fuel in the outlet pressure chamber 33 is supplied back through the throttled outlet 10 and the return conduit 31 into the fuel container 5. The delay time is determined substantially by a throttling opening 23 in the throttled outlet 10 of the delay valve 7. The delay time moreover can be post-adjusted by changing the prestressing which acts on the delay member 34. For this purpose an inlet pipe 35 and an outlet pipe 36 are arranged adjustably in the axially direction in the cylindrical housing 20 of the delay valve 7. For increase of the prestress of the spring element 22 they can be moved axially to one another and for reduction of the prestress of the spring element 22 they can move axially away from one another. A fine adjustment of the spring prestress and thereby the delay time, can be performed by screw connections between the cylindrical housing 20 of the delay valve 7 and the inlet pipe 35 and/or the outlet pipe 36.

The displacing or stroke movement of the displacing or stroke element 19 is limited in a third phase by the outlet pipe 36. In this phase, the inlet pressure chamber 32 is increased so that a direct short circuiting between the inlet 8 and the operational pressure outlet 9 of the delay valve 7 is produced. The third phase is maintained as long as a pressure is applied in the inlet 8. The displacing and stroke element 19 has a longitudinal groove 39 which makes possible a fuel return flow from the inlet pressure chamber 32 into the outlet pressure chamber 33. Therefore, the displacing or stroke element can displace back by the force of the spring element into the immovable position when the fuel supply conduit is pressureless.

Figure 3:
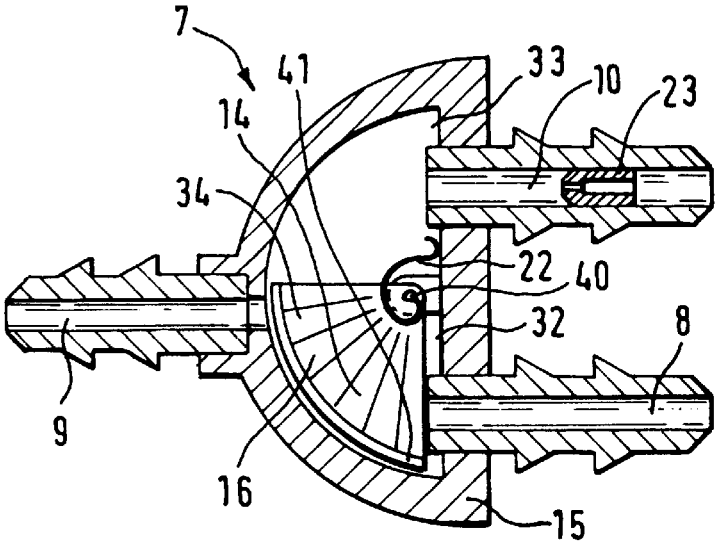
FIG. 3 is a view showing a second embodiment of a hydraulic delay valve in a first phase.
Figure 4:
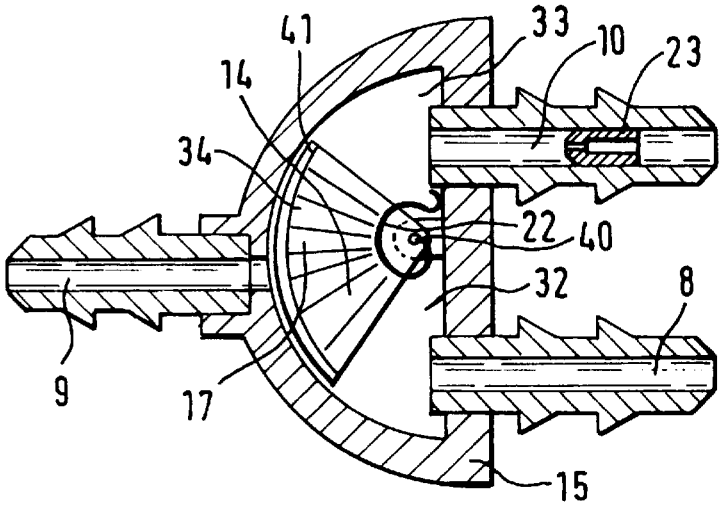
FIG. 4 is a view showing a second embodiment of a hydraulic delay valve of FIG. 3 in a second phase.
Figure 5:
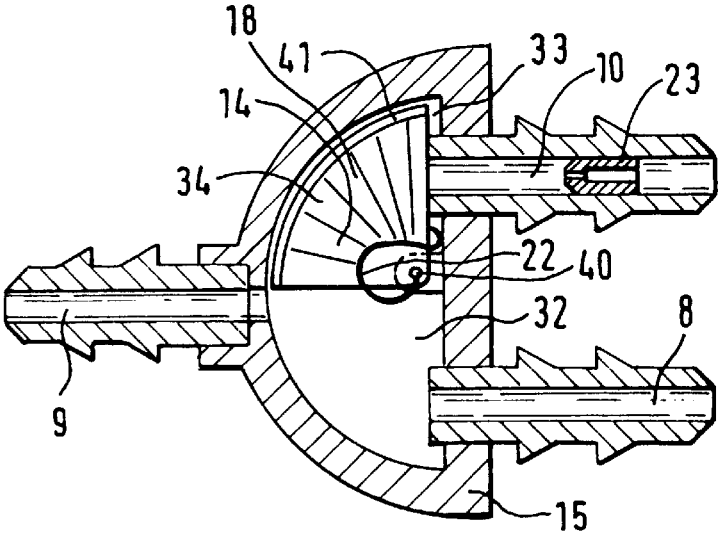
FIG. 5 is a view showing a second embodiment of a hydraulic delay valve of FIG. 3 in a third phase.

FIG. 3 shows a second embodiment of the hydraulic delay valve 7 with a turning element 14 in a first phase. The turning element 14 is arranged in a housing 15. It is supported turnably or rotatably about an axle 40 and closes an inlet 8 of the delay element 7 in its first phase. The turning element 14 subdivides a space which is enclosed by the housing into an inlet pressure chamber 32 and an outlet pressure chamber 33. A gap 41 connects the inlet pressure chamber 32 with the outlet pressure chamber 33. A prestressing device arranged outside of the housing acts on the axle 40. It holds the turning element in its immovable position, in which the inlet 8 remains closed as long as the fuel in the fuel supply conduit 3 is pressureless. The turning element 14 turns into a second phase 17, as shown in FIG. 4, from the first phase 16 which is immovable phase, and in a third phase 18 as shown in FIG. 5. This turning is performed as long as a pressure acts in the inlet so that the inlet pressure chamber 32 increases and the fuel in the outlet pressure chamber 33 is supplied through the throttling opening 33 into the outlet 10 into the supply container 5 via the return conduit 31.

The time of the turning movement defines the delay time of the delay valve 7. When the third phase is reached as shown in FIG. 5, the turning element closes the outlet 10 and opens the operational pressure outlet 9 which is connected through the inlet pressure chamber 22 in the third phase directly with the inlet 8. Since the operational pressure outlet 9 is directly connected with the inlet 12 of the pressure regulating valve, therefore in the third phase the pressure supply conduit 3 of the fuel supply system is short circuited with the pressure regulating valve through the intermediate conduit 11, the opened delay valve 7 and the inlet 12 of the pressure regulating valve. After elapsing of the delay time, the pressure regulating valve is activated and reduces the pressure in the fuel supply conduit 3 through an operational pressure which is required in the supply circuit and is regulated. The excessive fuel is supplied back into the supply container 5 through the outlet 13 of the pressure regulating valve and the return conduit 31. Both the delay valve as well as the pressure regulating valve can be designed as an integral component of the fuel supply unit, so that such a compact unit can be easily monitored and exchange in the case of defects.

The delay time is determined on the one hand by the design of the throttling opening 23 in the outlet 10 of the delay valve 7. On the other hand, it can be exactly determined by the regulation and adjustment of the prestressing device especially since the prestressing device in this preferable embodiment is arranged outside of the housing 15 of the delay valve 7 and acts on the axle of the turning element. The turning element in a preferable embodiment can be formed as a rotary piston and can be held in the third phase as long as a pressure at the inlet 8 of the delay valve 7 is produced. When this pressure drops to a normal pressure, the turning element 14 is pressed back to the immovable position by the prestressing device. The fuel flows back from the inlet pressure chamber 32 through a gap 41 into the outlet pressure chamber 33, until the turning element again reaches the immovable position and thereby the first phase.

It will be understood that each of the elements described above, or two or more together, may also find a useful application in other types of constructions differing from the types described above.

While the invention has been illustrated and described as embodied in fuel supply system for fuel supply of internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. A fuel supply system for fuel supply of an internal combustion engine, comprising a fuel supply container; a fuel supply unit having a pressure limiting value providing an adjustable maximum pressure; a fuel supply conduit having a pressure regulating valve adjustable to an operational pressure for maintaining a regulated operational pressure in said fuel supply conduit; a fuel return conduit adapted to connect the internal combustion engine with said fuel supply container; and a delay valve upstream of said pressure regulating valve for loading said fuel supply conduit with an initial pressure which is higher than an operational pressure.

2. A fuel supply system as defined in claim 1, wherein said delay valve is formed so that it loads said fuel supply conduit with an initial pressure which corresponds to the maximum pressure.

3. A fuel supply system as defined in claim 1, wherein said delay valve has an inlet, a delayed operational outlet, and a throttled outlet.

4. A fuel supply system as defined in claim 3, wherein said inlet of said delay valve is connected with a branch of said fuel supply conduit.

5. A fuel supply system as defined in claim 3, wherein said delayed operational pressure outlet of said delay valve is connected with an inlet of said pressure regulating valve.

6. A fuel supply system as defined in claim 3, wherein said throttled outlet of said delay valve is connected with said supply container.

7. A fuel supply system as defined in claim 1, wherein said pressure regulating valve has an outlet connected with said supply container.

8. A fuel supply system as defined in claim 1, wherein said delay valve has a housing and at least one prestressed turning element in said housing, said prestressed element being formed so that in a first phase it has an immovable position and thereby maintains said delay valve closed when a fuel in said fuel supply conduit is pressureless, a second phase in which it performs a delayed turning movement when said fuel supply conduit is set under pressure through said fuel supply unit and has a pressure which is higher than an operational pressure adjusted at said limiting valve and lower or equal to the maximum pressure of the pressure limiting valve, and a third phase in which it has an operational position in which an inlet of said delay valve is short circuited directly with an operational inlet of said pressure regulating valve through said delay valve.

9. A fuel supply system as defined in claim 1, wherein said delay valve has a housing and at least one prestressed displacing element arranged in said housing and having a first phase in which it is in an immovable position so that said delay valve is closed when a fuel in said supply conduit is pressureless, a second phase in which said displacing element performs delayed displacing movement when said fuel supply conduit is set under pressure by said fuel supply unit and has a pressure which is higher than the operational pressure adjustable at said pressure regulating valve and lower or equal to the adjusted maximum pressure of said pressure limiting valve, and a third phase in which it is in an operational position so that an inlet of said delay valve is short circuited directly with an operational pressure inlet of said pressure regulating valve through said delay valve.

10. A fuel supply system as defined in claim 1, wherein said delay valve has an element for adjusting a delay time of said delay valve, and a prestressing device for producing and adjusting a prestress of said element.

11. A fuel supply system as defined in claim 10, wherein said element is formed as a turning element.

12. A fuel supply system as defined in claim 10, wherein said delay element is formed as a displacing element.

13. A fuel supply system as defined in claim 1, wherein said delay valve has an element for adjusting a delay time, and a spring element for producing different prestresses of said element.

14. A fuel supply system as defined in claim 13, wherein said delay valve has a housing; and means for adjusting a prestress of said spring element located outside of the housing.

15. A fuel supply system as defined in claim 1, wherein said delay valve has a throttled outlet with a throttling opening provided in said throttled outlet.

* * * * *